US005298072A

United States Patent [19]

Schiele, deceased et al.

[11] Patent Number: 5,298,072

[45] Date of Patent: Mar. 29, 1994

[54] EDGE-COATING APPARATUS FOR PANEL WORKPIECES

[76] Inventors: Josef Schiele, deceased, late of Niederzissen; by Anneliese Schiele, heiress, Brohltalstrasse 153, 5476 Niederzissen; by Birgit M. Gros, heiress, Brohltalstrasse 153, 5476 Niederzissen; by Stefan G. Schiele, heir, Brohltalstrasse 153, 5476 Niederzissen; Gerhard Stahl, Gierenzheimer Strasse 28, 5483 Bad Neuenahr-Ahrweiler, all of Fed. Rep. of Germany

[21] Appl. No.: 27,142

[22] Filed: Mar. 5, 1993

[30] Foreign Application Priority Data

Mar. 6, 1992 [DE] Fed. Rep. of Germany ..... 4207090

[51] Int. Cl.[5] ..... B05C 5/02

[52] U.S. Cl. ..... 118/681; 118/684; 118/703; 118/50; 118/314; 118/323; 118/326; 239/124; 239/288; 427/284

[58] Field of Search ..... 118/50, 323, 324, 326, 118/681, 684, 673, 703, 314; 239/124, 288, 150; 68/200; 134/122 R; 427/284

[56] References Cited

U.S. PATENT DOCUMENTS

| | | | |
|---|---|---|---|
| 3,077,859 | 2/1963 | Cook | 118/50 |
| 4,333,417 | 6/1982 | Camp et al. | 118/50 |
| 4,857,367 | 8/1989 | Thorn et al. | 118/326 |
| 5,078,080 | 1/1992 | Schiele . | |

FOREIGN PATENT DOCUMENTS

| | | | |
|---|---|---|---|
| 3117355 | 8/1982 | Fed. Rep. of Germany | 118/50 |
| 3740201 | 6/1989 | Fed. Rep. of Germany . | |
| 4021174 | 1/1992 | Fed. Rep. of Germany . | |
| 1537534 | 1/1990 | U.S.S.R. | 118/50 |
| 1599120 | 10/1990 | U.S.S.R. | 118/50 |

*Primary Examiner*—W. Gary Jones
*Assistant Examiner*—Todd J. Burns
*Attorney, Agent, or Firm*—Herbert Dubno; Andrew Wilford

[57] ABSTRACT

An apparatus for painting an edge of a workpiece that is moving in a travel direction generally parallel to the edge past a painting station has a support movable horizontally transversely of the direction in the station and an actuator connected to the support for displacing the support transversely of the direction. A generally tubular casing mounted on the support has a rear end and a front end and a front plate engaged over the front end of the casing is formed with a narrow nose in turn formed with a notch having a shape complementary to the workpiece edge. The front plate is releasably secured over the front end of the casing. A vacuum tank adjacent the station has a large-diameter flexible vacuum hose connected to the rear end of the casing for drawing in air through the nose at the notch. The vacuum hose and casing are of generally the same flow cross section, and a paint supply adjacent the station has a pair of flexible paint-supply hoses connected to the front plate adjacent the notch for supplying coating liquid to the plate at the notch.

8 Claims, 4 Drawing Sheets

EDGE-COATING APPARATUS FOR PANEL WORKPIECES

FIELD OF THE INVENTION

The present invention relates to a system for coating the edges of a panel workpiece. More particularly this invention concerns a device for edge-coating such workpieces as they move past a stationary coating station.

BACKGROUND OF THE INVENTION

It is known to coat the edge of a workpiece as it is moving along in a direction generally parallel to its edge by flushing or spraying the edge with a liquid and then sucking the excess liquid off the edge. In this manner the liquid, which is hereinafter referred to as paint but which could also be primer, lacquer, preservative, or any other desired treatment liquid, is not left in drops or puddles on the edge so that a very smooth and uniform coating is achieved.

According to German patent document 4,021,174 filed 3 Jul. 1990 by J. Schiele the liquid is applied to the workpiece edge from a paint-filled chamber that opens via a vertical slit at the vertical edge and vacuum is applied to this chamber to remove the excess paint. This system is an improvement on the arrangement described in U.S. Pat. No. 5,078,080 (citing German patent document 3,740,201) in that it allows the equipment to be somewhat centralized.

The major problem remains that the edge-coating system is a fairly complex installation that must be set up for each particular workpiece type. When workpiece edge profile, height, thickness, width, or shape changes it is necessary to shut down the entire machine, change various parts, and then make numerous adjustments to accommodate the new workpieces.

OBJECTS OF THE INVENTION

It is therefore an object of the present invention to provide an improved edge-coating system.

Another object is the provision of such an improved edge-coating system which overcomes the above-given disadvantages, that is which can easily adapt or be made to adapt to different workpieces.

Summary of the Invention

An apparatus for painting an edge of a workpiece that is moving in a travel direction generally parallel to the edge past a painting station has according to the invention a support movable horizontally transversely of the direction in the station and an actuator connected to the support for displacing the support transversely of the direction. A generally tubular casing mounted on the support has a rear end and a front end and a front plate engaged over the front end of the casing is formed with a narrow nose in turn formed with a notch having a shape complementary to the workpiece edge. The front plate is releasably secured over the front end of the casing. A vacuum tank adjacent the station has a large-diameter flexible vacuum hose connected to the rear end of the casing for drawing in air through the nose at the notch. The vacuum hose and casing are of generally the same flow cross section, and a paint supply adjacent the station has a pair of flexible paint-supply hoses connected to the front plate adjacent the notch for supplying coating liquid to the plate at the notch.

Thus the system of this invention dispenses with the voluminous coating head, and instead in effect forms the coating head as nothing larger than a nozzle on the end of the suction hose. The apparatus works better than the prior-art systems, only using about 50% as much energy as the prior-art systems while forming an extremely uniform coating. The sump filled with coating liquid is eliminated completely, and the vacuum chamber right at the workpiece is reduced to a bare minimum, with no deleterious effection efficiency. The amount of paint wasted is also reduced greatly as it cannot build up and get caked in corners of the system, since its volume itself is greatly reduced so it has fewer dead spots and the like. The amount of coating liquid actually aspirated and recirculated is greatly reduced, indeed close to 100% of the paint applied to the edge stays there with only the tiny extra amount being sucked back in through the nozzle. The drops traditionally formed at the ends of the edges are completely eliminated, principally because the nose of the front plate has a much smaller dimension measured in the workpiece-travel direction than the prior-art systems.

As a result it is much easier to manipulate the coating head, To this end the support can also be movable vertically and in the transport direction. The apparatus further has according to the invention respective additional actuators for displacing the support vertically and in the transport direction. What is more, the support is movable transversely between an advanced position with the notch engaged over the edge of the workpiece and a retracted position with the edge remote from the workpiece. The apparatus further has according to the invention valves associated with the paint-supply hoses operable for blocking flow therethrough, a switch for generating an output when the support is in the retracted position, and a controller connected between the valves and switch for closing the valves when the switch generates its output.

The edge-painting apparatus further has according to the invention a sensor for detecting a position of the workpiece edge transversely of the direction, and a controller connected between the sensor and the actuator for positioning the notch over the workpiece edge in accordance with the detected position thereof. In fact according to the invention the support is movable transversely between an advanced position with the notch engaged over the edge of the workpiece and a retracted position with the edge remote from the workpiece and the apparatus further has a valve associated with the paint-supply hoses and operable for blocking flow therethrough. A switch generates an output when the support is in the retracted position. The controller is connected between the valve and switch for closing the valve when the switch generates its output and includes a time delay for moving the head into the retracted position a predetermined time after the sensor fails to detect a workpiece edge. Thus if there is no edge to coat, the head is retracted and its paint supply is shut off.

The edge-painting apparatus further has according to the invention a second such support, actuator means, casing, front plate, vacuum hose, and pair of paint-supply hoses forming a second head separate from the head formed by the first such support, actuator means, casing, front plate, vacuum hose, and pair of paint-supply hoses, and a sensor for detecting the shape of the workpiece edge. The notches of the first and second plates are differently shaped for differently shaped workpiece edges. The apparatus further has according to the invention a controller connected to the means and an actuator for advancing one of the heads transversely into engagement over the workpiece edge when the sensor detects an edge shape corresponding to that of the notch of the one head and for retracting the other head transversely away from the workpiece edge. Thus when a workpiece with a differently shaped head arrives at the coating station, the currently working head is retracted and its paint supply is shut off, and the other head is advanced and it supply is turned on, all automatically. While the one is retracted, its front plate can be changed so that the machine is not down at all when workpieces are changed.

The edge-painting apparatus further has according to the invention an adjustable flow-control valve in each paint-supply hose. Thus it is possible to dispense different quantities of coating liquid, which as described above is typically paint, to the top and bottom edge regions of the workpiece.

In addition the system of this invention has a conveyor for displacing the workpiece longitudinally generally parallel to its edge past the station and including holddown rollers transversely spaced from the station for preventing transverse movement of the workpiece as it passes the station. This is necessary because the small-format head according to the invention can exert enough suction to actually pull the workpiece laterally if all that is holding it down is its own weight.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
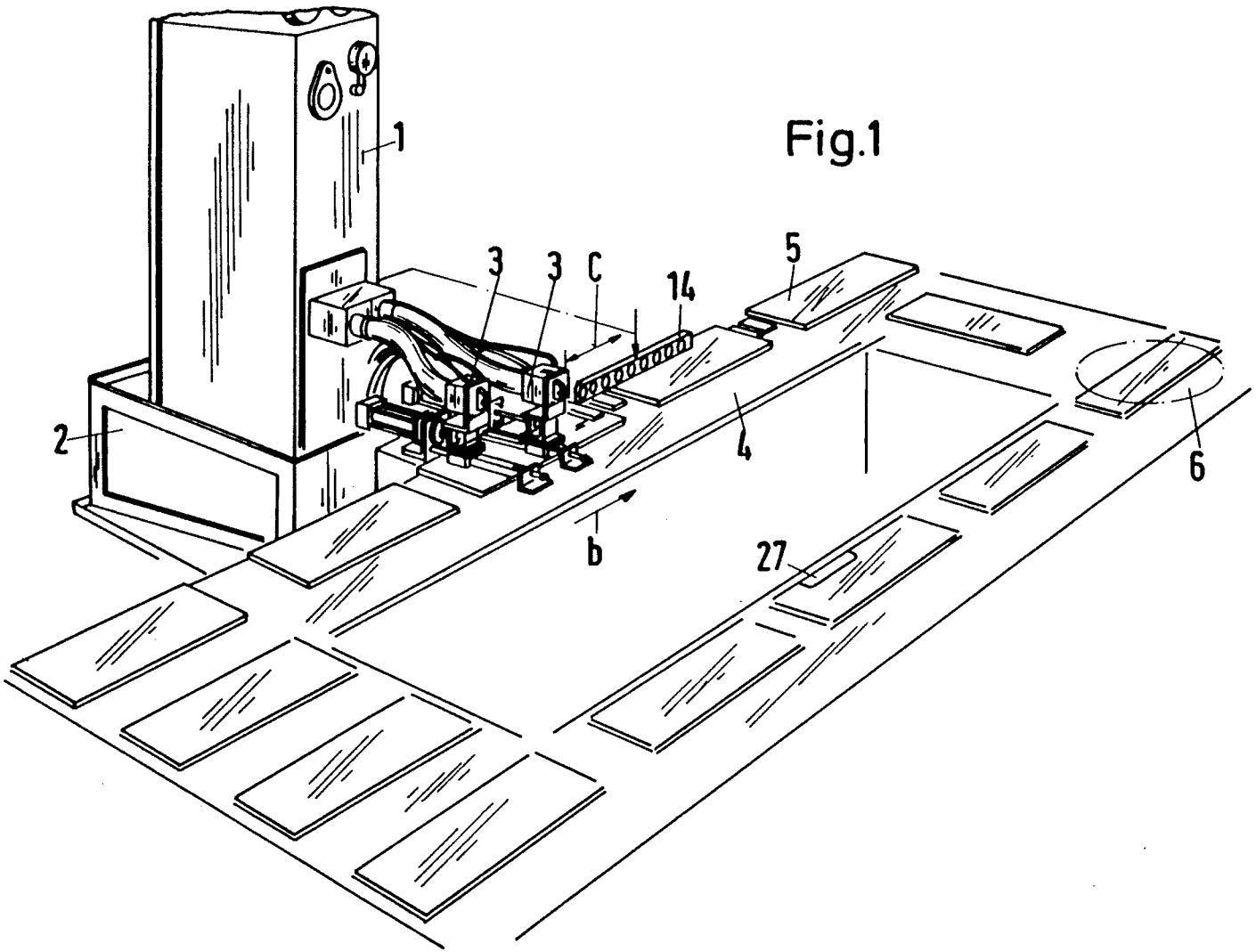
FIG. 1 is a mainly diagrammatic view of the system of this invention.

As seen in FIG. 1 a vacuum tank 1 mounted atop a paintfeed apparatus 2 as described in above-cited U.S. Pat. No. 5,078,080 is connected to two separate edge-coating heads 3 which are arranged adjacent a conveyor 4 for workpieces 5 whose edges are to be coated. The conveyor 4 runs in a rectangular path and has at least one corner provided with a turntable 6 so that any edge of any of the workpieces 5 can be oriented to be parallel to the transport direction D adjacent the heads 3 and also directed horizontally toward these heads 3.

Figure 2:
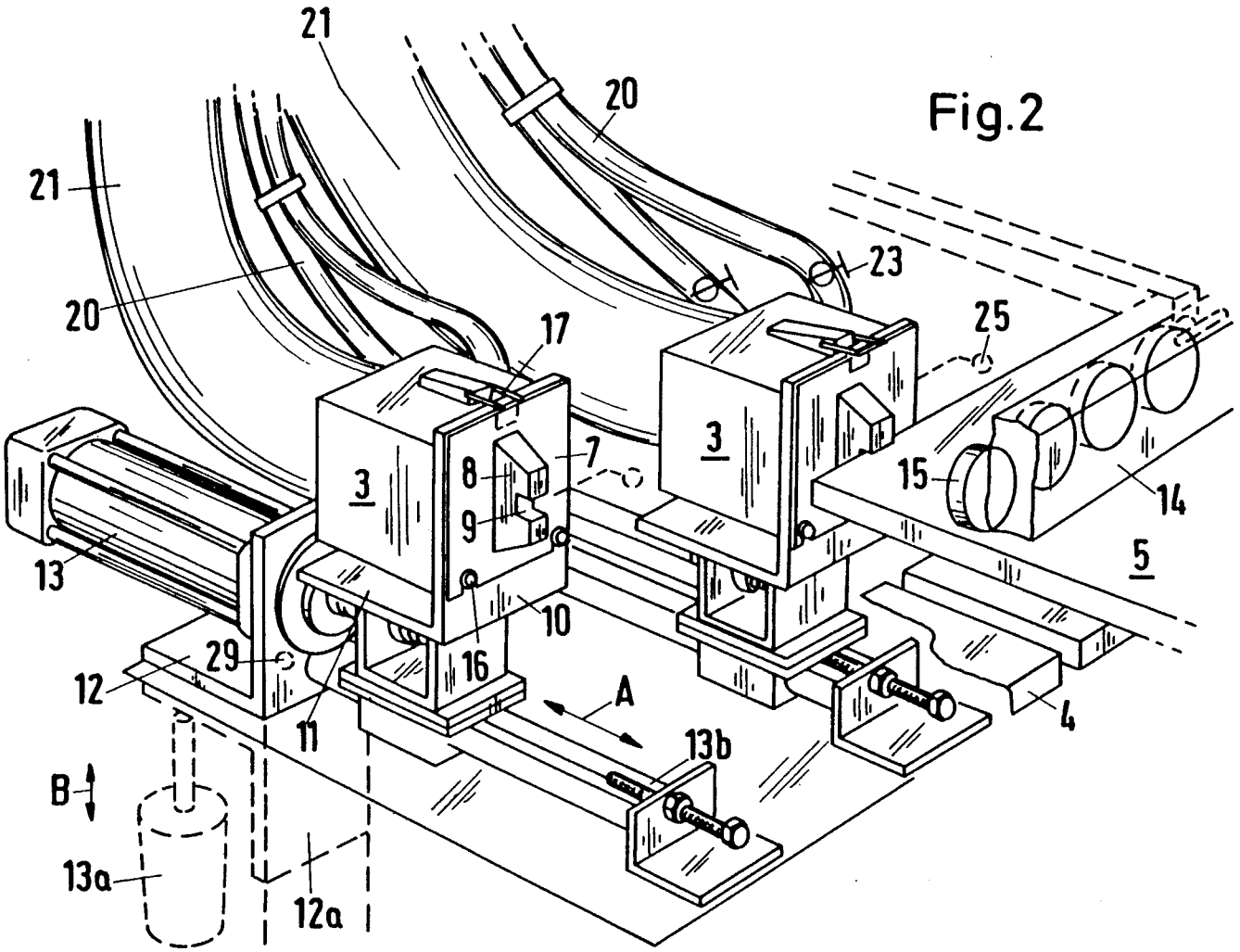
FIG. 2 is a partly diagrammatic perspective view of a detail of the edge-coating apparatus.
Figure 6:
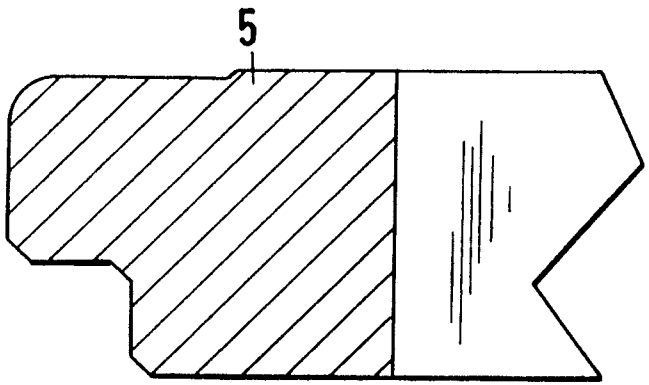
FIG. 6 is a section through a workpiece edge.

As better shown in FIG. 2 each head 3 has a removable and vertically oriented front plate 7 formed with a horizontally projecting coating nose 8 that is relatively narrow measured in the direction D and that is formed with a horizontally open square-section notch 9 shaped to conform to the workpiece edge to be coated (See FIG. 6.). Each head 3 is mounted on the vertical leg 10 of an angle bracket 10, 11 having a horizontal leg mounted on an actuator 13 for movement in a horizontal direction A perpendicular to the transport direction D. Movement in the direction A toward the workpiece 5 is limited by an adjustable stop 13*b*. This actuator 13 in turn is mounted on a bracket 12 secured to a vertically effective actuator 13*a* that can move it, and the head 3 with it, in a vertical direction B. Another such actuator can be provided for shifting each head 3 in a direction C (See FIG. 1.) parallel to the direction C.

The conveyor 4 is provided with a holddown bar 14 provided with rollers 15 rotatable about horizontal axes perpendicular to the direction D. This arrangement ensures that the workpieces are clamped to the conveyor 4 as they move longitudinally past the coating heads 3 and cannot shift transversely.

Each front plate 7 is formed at its lower end with notches that fit over bolts 16 on the respective head 3 and is secured along its upper edge by a spring-type clamp arm 17 to hold it tightly in place. Such mounting makes it relatively easy to switch front plates when workpiece profile changes.

Figure 4:
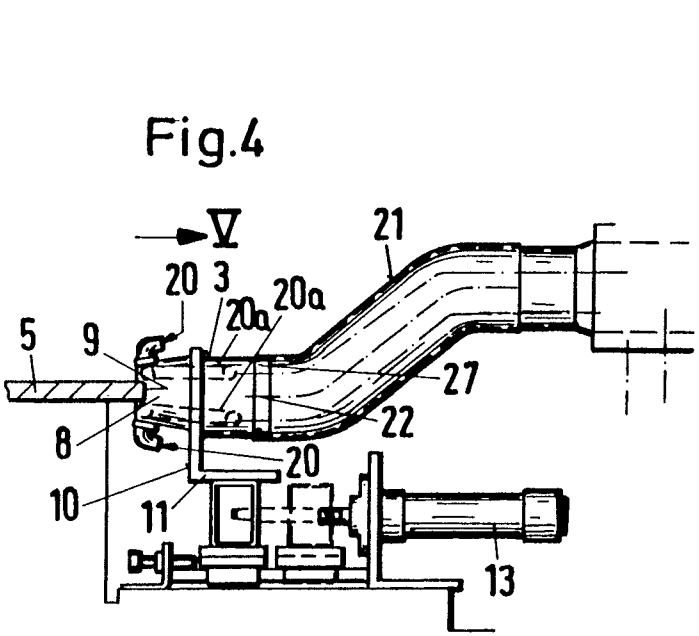
FIG. 4 is a large-scale view of the detail indicated in circle IV of FIG. 3.
Figure 5:
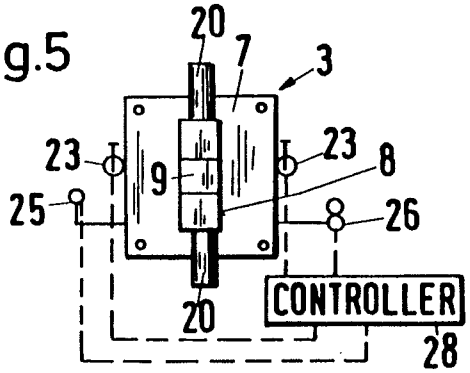
FIG. 5 is a partly diagrammatic end view taken in the direction of arrow V of FIG. 4.
Figure 3:
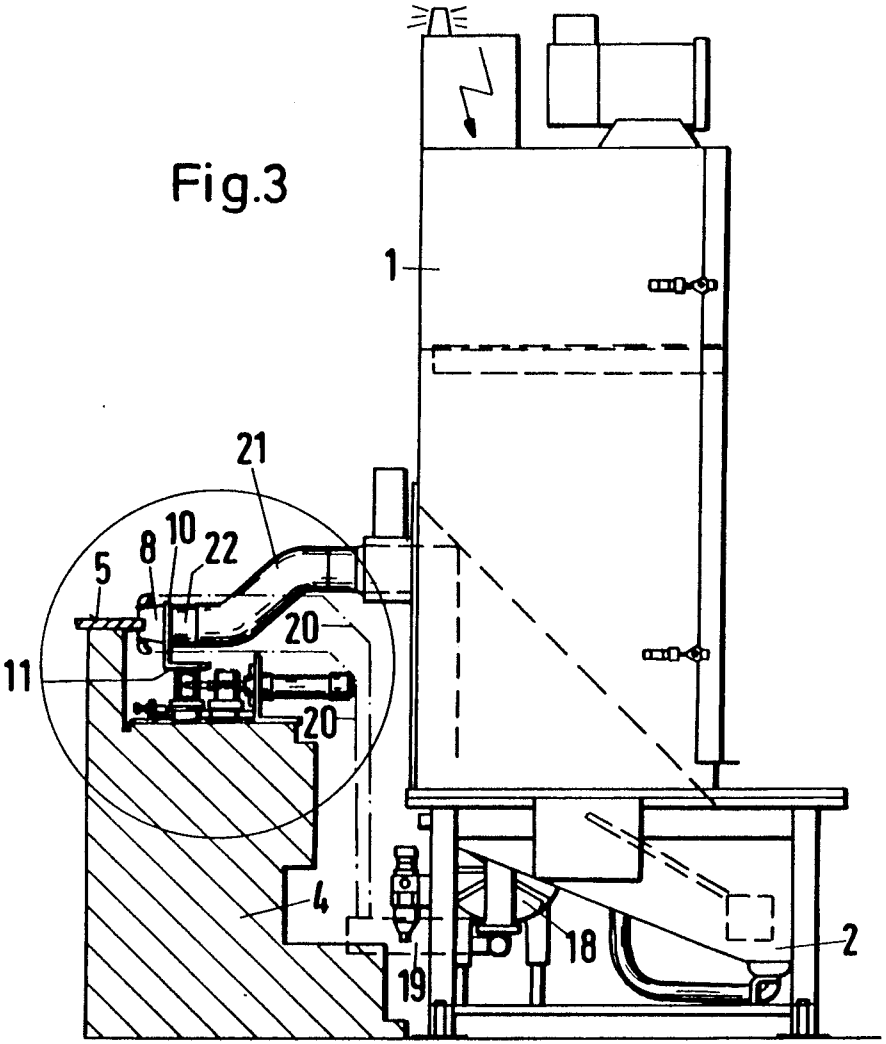
FIG. 3 is an end view partly in vertical section of the edge-coating apparatus.

FIGS. 3 through 5 show how a pump 18 of the paint-feed system 2 has a mixing fitting 19 connected via two respective paint feed lines or hoses 20 to each head 3. In addition each head 3 is connected via a large-diameter suction conduit or hose 21 to the vacuum chamber 1. To this end each head 3 has a casing 22 shaped to releasably fit in the end of the respective hose 21 and in fact each head 3 is of a size that is generally much smaller than the casing 22 or hose 21.

FIG. 4 shows how the casing 22 of each head 3 is constituted as a tubular nozzle that fits in the outer end of the respective hose 21 and that carries the respective plate 7 on its open front end. This plate 7 is in turn integrally formed with the notched nose 8 that is shaped to fit exactly over the edge of the workpiece 5 whose edge is to be coated. The cross-sectional size and internal volume of the casing 22 is much smaller than the comparable dimensions of the respective hose 21 so that substantial suction can be produced in the slit of the notch 9. The hoses 20 are connected either directly to the plate 7 to open into the notch 9 or can be fed as illustrated at 20*a* through the hose 21 to the nozzle 9. In either case they are provided with individual flow-control valves 23 operated by a controller 28 shown only in FIG. 5. It is also possible to run a single paintfeed hose from the supply 2 and to branch it at the head 3 for upper and lower feed to the workpiece edge. A releasable clamp 27 secures the outer end of the hose 21 to the casing 22.

Figure 7:
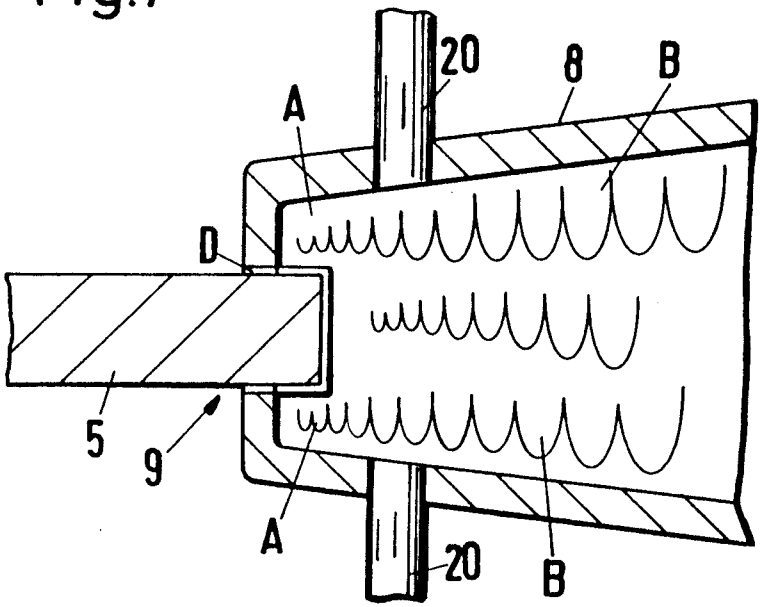
FIG. 7 is a vertical section through the applicator nose.

As seen in FIG. 7, each notch 9 fits complementarily around a workpiece edge with a small amount of play forming a gap D. Since the interior of the nose 8 is actually a fairly deep vacuum, the treatment liquid introduced by the conduits 20 will be atomized by the turbulences shown at A, creating a fine mist that coats the workpiece edge thoroughly. The turbulence shown at B downstream of the edge draws off excess paint while ensuring perfect coating of all surfaces. The openings of the conduits 20 are not normally directly in line with the suction slit, but can be.

FIG. 5 further shows how the head 3 can be associated with upstream and downstream proximity and edge-shape detectors 25 and 26 which are connected to the controller 28. In addition this controller 28 is connected to the various actuators for movement in the direction A, B, and C so that the head 3 can follow a workpiece edge even when same does not run perfectly parallel to the direction D. What is more, each head 3 actuates a respective rest switch 29 when in a fully retracted position as shown to the left in FIG. 2. This switch 29 is also connected to the controller closes the valves 23 for a head 3 when same has been pulled back and is not in use.

It is therefore possible for the heads 3 to follow a workpiece edge when same is not parallel to the direction D or even when it is not straight. What is more when a detector 26 determines that the profile of the workpiece edge does not correspond to that of the respective notch 9, the respective head 3 is retracted and its paint supply is shut off, and the other head 3, which has an appropriately shaped notch 9, is advanced and its paint supply is turned on to coat the new workpiece.

The front plates 7 are normally cast and precision machined for the particular workpieces whose edges are to be coated. Their rear faces that fit with the front edge of the respective casing 22 are all the same and are provided with standardized seats for the hoses 20. Thus when the workpieces edge shape changes, the user need merely shut off the paint feed to a head, and undo the clip 17 to take off the plate 7, then clamp the new plate in place and turn the paint feed back on to be ready to start work again. This can be done while the other head 3 is still working.

We claim:

1. An apparatus for painting an edge of a workpiece that is moving in a travel direction generally parallel to the edge past a painting station, the apparatus comprising:

a support movable horizontally transversely of the direction in the station;

actuator means connected to the support for displacing the support transversely of the direction;

a generally tubular casing mounted on the support and having a rear end and a front end;

a front plate engaged over the front end of the casing and formed with a narrow nose which is in turn formed with a notch having a shape complementary to the workpiece edge, the casing and front plate together forming a vacuum applicator head;

means for releasably securing the front plate over the front end of the casing;

means including a vacuum tank adjacent the station having a large-diameter flexible vacuum hose connected to the rear end of the casing for drawing in air through the nose at the notch, the vacuum hose and casing being of generally the same flow cross section; and means including a paint supply adjacent the station having a pair of flexible paint-supply hoses connected to the front plate adjacent the notch for supplying coating liquid to the plate at the notch.

2. The edge-painting apparatus defined in claim 1 wherein the support is also movable vertically and in the transport direction, the apparatus further comprising:

respective additional actuators for displacing the support vertically and in the transport direction.

3. The edge-painting apparatus defined in claim 1 wherein the support is movable transversely between an advanced position with the notch engaged over the edge of the workpiece and a retracted position with the edge remote from the workpiece, the apparatus further comprising valve means associated with the paint-supply hoses operable for blocking flow therethrough;

switch means for generating an output when the support is in the retracted position; and control means connected between the valve and switch means for closing the valve means when the switch means generates its output.

4. The edge-painting apparatus defined in claim 1, further comprising sensor means for detecting a position of the workpiece edge transversely of the direction; and control means connected between the sensor means and the actuator means for positioning the notch over the workpiece edge in accordance with the detected position thereof.

5. The edge-painting apparatus defined in claim 4 wherein the support is movable transversely between an advanced position with the notch engaged over the edge of the workpiece and a retracted position with the edge remote from the workpiece, the apparatus further comprising valve means associated with the paint-supply hoses operable for blocking flow therethrough; and switch means for generating an output when the support is in the retracted position, the control means being connected between the valve and switch means for closing the valve means when the switch means generates its output and including a time delay for moving the head into the retracted position a predetermined time after the sensor means fails to detect a workpiece edge.

6. The edge-painting apparatus defined in claim 1, further comprising a second such support, actuator means, casing, front plate, vacuum hose, and pair of paint-supply hoses separate from the first such support, actuator means, casing, front plate, vacuum hose; and pair of paint-supply hoses, and sensor means for detecting the shape of the workpiece edge, the notches of the first and second plates being differently shaped for differently shaped workpiece edges; the apparatus further comprising control means connected to the sensor means and actuator means for advancing one of the heads transversely into engagement over the workpiece edge when the sensor means detects an edge shape corresponding to that of the notch of the one head and for retracting the other head transversely away from the workpiece edge.

7. The edge-painting apparatus defined in claim 1, further comprising an adjustable flow-control valve in each paint-supply hose.

8. The edge-painting apparatus defined in claim 1, further comprising conveyor means for displacing the workpiece longitudinally generally parallel to its edge past the station and including holddown rollers transversely spaced from the station for preventing transverse movement of the workpiece as it passes the station.

* * * * *